US005888006A

United States Patent [19]

Ping et al.

[11] Patent Number: 5,888,006

[45] **Date of Patent: *Mar. 30, 1999**

[54] CLEANING IMPLEMENT HAVING A SPRAYER NOZZLE ATTACHED TO A CLEANING HEAD MEMBER

[75] Inventors: Vernon S. Ping, Cincinnati; Steven M. Schennum, West Chester, both of Ohio; Noelle M. Dye, Charlestown; John D. Gundlach, Rowley, both of Mass.

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 756,774

[22] Filed: Nov. 26, 1996

[51] Int. Cl.[6] ..... A47L 13/22

[52] U.S. Cl. ..... 401/137; 401/138; 401/139; 401/140

[58] Field of Search ..... 401/139, 140, 401/138, 137, 136, 27, 289, 282, 284

[56] References Cited

U.S. PATENT DOCUMENTS

| | | | |
|---|---|---|---|
| D. 364,715 | 11/1995 | Amram et al. | D32/35 |
| 371,515 | 10/1887 | Nowotny | 401/137 |
| 539,313 | 5/1895 | Thierry et al. | 401/284 X |
| 1,033,222 | 7/1912 | Whitehead | 410/137 |
| 1,413,700 | 4/1922 | Allen | 401/136 |
| 1,739,983 | 12/1929 | Nelson et al. | 401/137 M |
| 1,903,896 | 4/1933 | Greenberg | 401/137 |
| 2,262,334 | 11/1941 | Rugaard | 401/139 |
| 2,470,837 | 5/1949 | Polson | 401/138 |
| 3,094,152 | 6/1963 | Kenny et al. | 401/138 X |
| 3,099,028 | 7/1963 | Ardito | 401/136 X |
| 3,113,335 | 12/1963 | Baicker | 401/139 |
| 4,119,386 | 10/1978 | Cushing | 401/138 |
| 4,151,955 | 5/1979 | Stouffer | 239/11 |
| 4,432,472 | 2/1984 | Lamm | 401/138 X |
| 4,508,267 | 4/1985 | Stouffer | 239/11 |
| 4,971,471 | 11/1990 | Sloan | 401/140 |
| 5,007,753 | 4/1991 | England, Jr. | 401/139 |
| 5,496,123 | 3/1996 | Gaither | 401/176 |

FOREIGN PATENT DOCUMENTS

| | | | |
|---|---|---|---|
| 2409739 | 7/1979 | France | 401/27 |
| 2639818 | 6/1990 | France . | |
| 3940-123-A | 12/1989 | Germany . | |
| 571834 | 6/1958 | Italy | 401/146 |
| 582329 | 9/1958 | Italy | 401/137 |
| 06197855 | 7/1994 | Japan . | |

*Primary Examiner*—Steven A. Bratlie
*Attorney, Agent, or Firm*—Elizabeth M. Koch

[57] ABSTRACT

A cleaning implement having a liquid delivery system, includes a handle with first and second ends, a cleaning head member attached to the handle at the first end, and a sprayer nozzle preferably attached to the cleaning head member, independent of the handle, for providing increased directional control of the sprayer nozzle.

17 Claims, 2 Drawing Sheets

CLEANING IMPLEMENT HAVING A SPRAYER NOZZLE ATTACHED TO A CLEANING HEAD MEMBER

FIELD OF THE INVENTION

This invention relates to the field of cleaning implements, and more particularly, to a cleaning implement having a handle, a cleaning head member and a sprayer nozzle attached to the cleaning head member, independent of the handle, for providing increased control of the direction of the fluid dispensed from the sprayer nozzle.

BACKGROUND OF THE INVENTION

Conventional straight handled cleaning implements, such as mops, are known and typically comprise a handle attached to a substantially flat cleaning head member by a universal joint. These devices are generally controlled by applying a force to the handle which results in the cleaning head member moving in the direction of the force. Cleaning implements which utilize a universal joint have increased maneuverability by rotating the shaft of the handle. In this way, the cleaning head member moves in a clockwise or counter-clockwise direction depending on the rotation of the handle.

In addition, cleaning implements are known which include a liquid delivery system to dispense cleaning fluid through a sprayer nozzle, in the vicinity of the cleaning head member. However, these cleaning implements typically utilize a sprayer nozzle attached to the handle of the cleaning, implement and not directly to the cleaning head member. As a result, there is limited ability to control the direction of the sprayer nozzle, and consequently, an inability to control the direction of the fluid which is dispensed.

Unlike the cleaning head member, a sprayer nozzle mounted on the handle will not move in the direction of the cleaning head member, but will instead, only rotate with the handle's shaft. As a result, the sprayer nozzle cannot be controlled to the same degree as the cleaning head member. Therefore, the fluid dispensed by the sprayer nozzle will be directed away from the cleaning head member, and more importantly, away from the cleaning surface. In addition, the fluid dispensed in this manner could be dispensed on objects and/or surfaces which are not intended to be cleaned. In this way, the cleaning fluid is wasted and, in some cases, may ruin items such as furniture.

Straight handled cleaning implements are also known which utilize a sprayer nozzle attached to the bottom of the cleaning surface. However, this is undesirable when using a cleaning fabric which is designed to wick the cleaning fluid from the cleaning surface as this type of system does not allow the cleaning fluid to contact the cleaning surface for a sufficient period of time to provide maximum cleaning.

Therefore, what is needed is a cleaning implement having a sprayer nozzle attached to the cleaning head member, independent of the handle, for providing increased directional control of the sprayer nozzle.

SUMMARY OF THE INVENTION

Accordingly, it is an object of the present invention to provide an improved cleaning implement having a sprayer nozzle.

It is a further object of the present invention to provide a cleaning implement having a liquid delivery system, a handle with first and second ends, a cleaning head member preferably attached to the handle at the first end, and a sprayer nozzle attached to the cleaning head member, independent of the handle, for dispensing liquid from the liquid delivery system providing increased directional control of the sprayer nozzle.

DETAILED DESCRIPTION OF THE INVENTION

Figure 2:
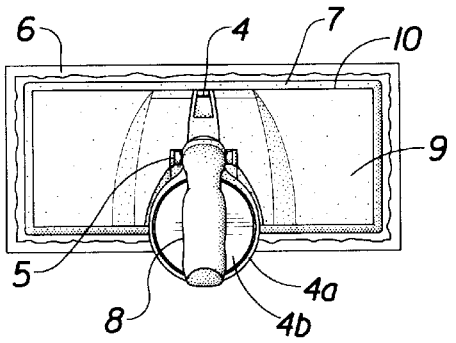
FIG. 2 is a top view of the preferred cleaning implement according to the preferred embodiment of the present invention.

Referring to FIGS. 1–4, the preferred cleaning implement 1 comprises a handle 2, a cleaning head member 3 and a sprayer nozzle 4, attached to the cleaning head member 3, independent of the handle 2, for providing increased directional control of the sprayer nozzle 4, and subsequently, the fluid dispensed from the sprayer nozzle 4. In this way, the quantity, trajectory, partical size, and fan angle 13 of the liquid delivered from the sprayer nozzle 4 can be controlled, relative to the cleaning head member 3, for maximum cleaning results.

The cleaning head member 3 is preferably pivotally attached to the handle 2 at a first end by a universal joint 5 but may be attached in a variety of ways. The sprayer nozzle 4 is fed by a liquid delivery system 4*a* having a liquid filled canister 4*b*, both of which are preferably attached to the handle 2. The preferred implement 1 also includes a cleaning fabric 6 removably attached to a substantially flat lower surface 7, preferably a foam bumper pad, of the head member 3. The cleaning fabric 6 is preferably attached using hook fasteners which are molded onto the surface 7. In addition, the preferred implement 1 includes an ergonomic grip 8 but may not utilize any grip without deviating from the intent of the invention.

The sprayer nozzle 4 is preferably attached to the upper surface 9 of the head member 3, adjacent the leading edge 10. In this way, the sprayer nozzle 4 moves in the direction of the head member 3 when the preferred implement is maneuvered. Specifically, the preferred implement 1 is maneuvered by rotating the handle 2 in a clockwise direction 11 or counter-clockwise direction 12. As a result, the rotational force will be translated, via the universal joint 5, to the head member 3 which will pivot correspondingly in the clockwise direction 11 or counter-clockwise direction 12, depending on the rotational direction of the handle 2.

Figure 1:
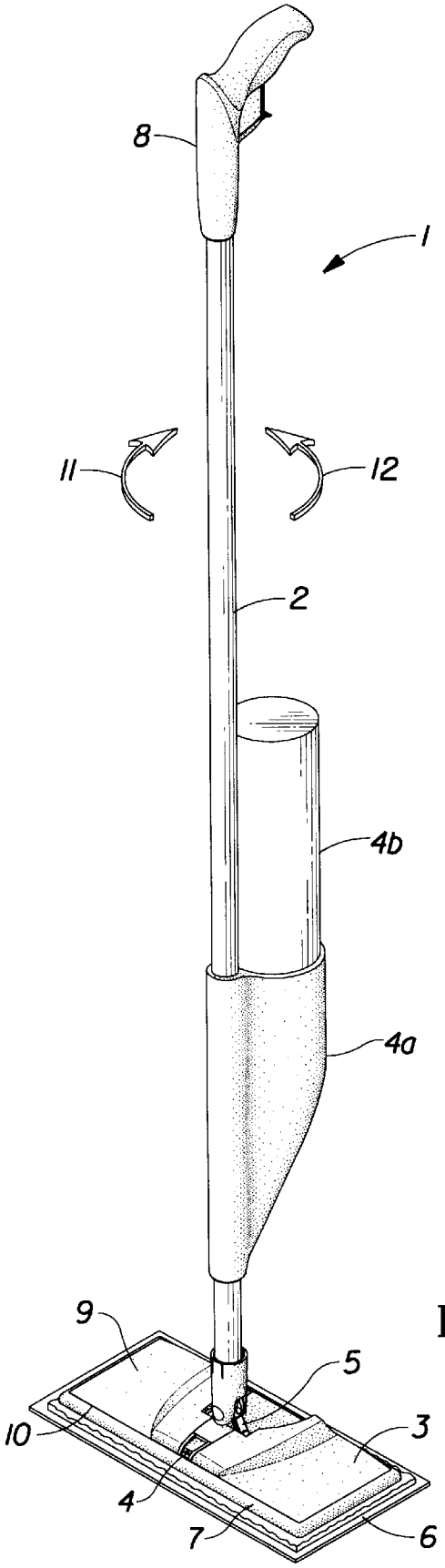
FIG. 1 is a perspective view of the preferred cleaning implement according to the preferred embodiment of the present invention.
Figure 3A:
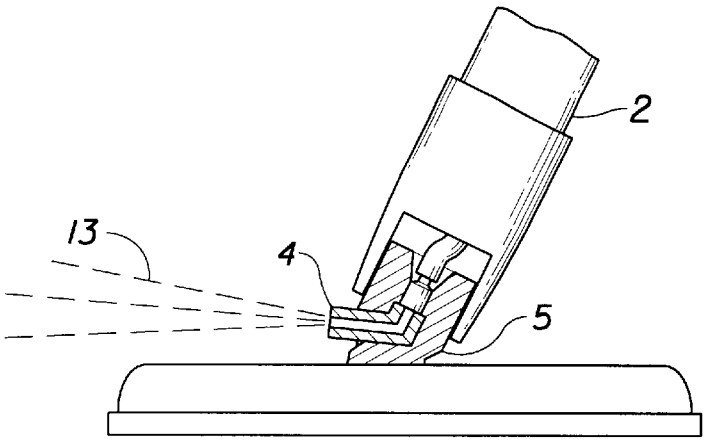
FIGS. 3*a* and 3*b* are an enlarged side and front view, respectively of the sprayer nozzle mounted on the universal joint.
Figure 3B:
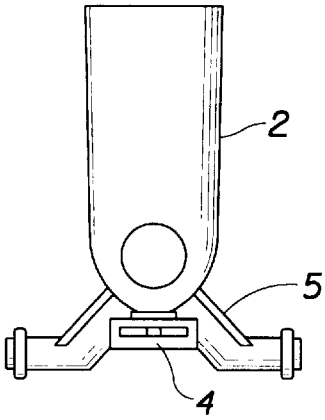
Figure 4A:
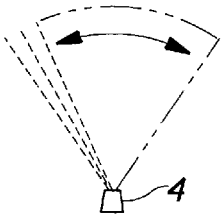
FIGS. 4*a–c* are top views of an oscillating spray, a fan angled spray and a spray having uniform distribution, respectively.
Figure 4B:
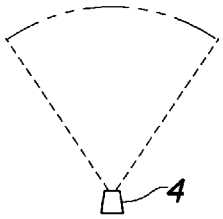
Figure 4C:
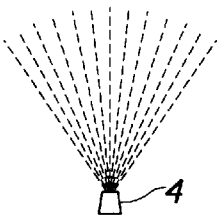

Alternatively, the sprayer nozzle 4 may be attached to the lower section of the universal joint 5 as shown in FIGS. 32 and 36 or within the head member 3 as shown in FIG. 1 without deviating from the intent of the invention. By attaching the sprayer nozzle 4 to the head member 3, or alternatively the lower section of the universal joint 5, the sprayer nozzle 4 follows the direction of the pivoting head member 3 and not the direction of the handle 2 as in the prior art. In this way, the preferred implement 1 enables delivery of the cleaning fluid in the direction of the head member 3, thereby providing optimum cleaning by focusing the cleaning fluid on the desired surface.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A cleaning implement having a liquid delivery system for cleaning a surface, comprising:

a handle having first and second ends;

a cleaning head member having a longitudinal axis, said cleaning head member pivotally attached to said first end of said handle via a multiple axis joint; and a sprayer nozzle for spraying liquid from the liquid delivery system away from said cleaning head member in a direction perpendicular to said longitudinal axis, directly to the surface to be cleaned, wherein said sprayer nozzle is attached to said cleaning head member thereby enabling rotational movement of said handle to provide increased directional control of said sprayer nozzle.

2. The cleaning implement of claim 1, further comprising a cleaning fabric removably attached to said cleaning head member.

3. The cleaning implement of claim 2, wherein said cleaning head member has a substantially flat surface.

4. The cleaning implement of claim 3, wherein said cleaning fabric is attached to said substantially flat surface.

5. The cleaning implement of claim 4, wherein said sprayer nozzle is attached on an upper surface of said cleaning head member, opposite of said substantially flat surface.

6. The cleaning implement of claim 1, wherein said cleaning head member is pivotally attached to said handle by a universal joint.

7. The cleaning implement of claim 1, wherein said sprayer nozzle is attached within said cleaning head member.

8. The cleaning implement of claim 1, further comprising an ergonomic grip member attached to said second end of said handle.

9. The cleaning implement of claim 1, wherein said sprayer nozzle has at least one of a fluidic oscillating spray, a fan angled spray and a uniform distribution spray.

10. The cleaning implement of claim 1, wherein said sprayer nozzle sprays liquid from the liquid delivery system in front of said cleaning head member.

11. A cleaning implement having a liquid delivery system for cleaning a surface, comprising:

a handle having first and second ends;

a cleaning head member having a longitudinal axis, said cleaning head member pivotally attached to said first end of said handle via a universal joint; and a sprayer nozzle for spraying liquid from the liquid delivery system away from said cleaning head member in a direction perpendicular to said longitudinal axis, directly to the surface to be cleaned, wherein said sprayer nozzle is attached to said cleaning head member thereby enabling rotational movement of said handle to provide increased directional control of said sprayer nozzle.

12. The cleaning implement of claim 11, further comprising a cleaning fabric removably attached to said cleaning head member.

13. The cleaning implement of claim 12, wherein said cleaning head member has a substantially flat surface.

14. The cleaning implement of claim 13, wherein said cleaning fabric is attached to said substantially flat surface.

15. The cleaning implement of claim 11, further comprising an ergonomic grip member attached to said second end of said handle.

16. The cleaning implement of claim 11, wherein said sprayer nozzle has at least one of a fluidic oscillating spray, a fan angled spray and a uniform distribution spray.

17. The cleaning implement of claim 11, wherein said sprayer nozzle sprays liquid from the liquid delivery system in front of said universal joint.

* * * * *